United States Patent [19]

Mayr

[11] Patent Number: 5,056,626

[45] Date of Patent: Oct. 15, 1991

[54] ELEVATING STAGE

[76] Inventor: August Mayr, Ismaniger Strasse 114,, D-8000 München 60, Fed. Rep. of Germany

[21] Appl. No.: 496,658

[22] Filed: Mar. 21, 1990

[30] Foreign Application Priority Data

Mar. 29, 1989 [DE] Fed. Rep. of Germany ..... 3910180

[51] Int. Cl.[5] ..... B66B 11/04

[52] U.S. Cl. ..... 187/18; 254/122; 182/141

[58] Field of Search ..... 187/18, 8.71, 8.72; 182/141, 158, 157; 254/122, 10 R, 10 C, 264

[56] References Cited

U.S. PATENT DOCUMENTS 3,476,016 11/1969 Dixon et al. ..... 187/18

3,672,104 6/1972 Luckey ..... 187/18

*Primary Examiner*—Robert P. Olszewski

*Assistant Examiner*—Kenneth Noland

*Attorney, Agent, or Firm*—Watson, Cole, Grindle & Watson

[57] ABSTRACT

An elevating stage that can be raised by a power drive comprises scissor beams of lifting scissors which are bent in the middle at an upward pointing angle of bend. The moving joints of the scissor beams are offset laterally within respect to one another in such a manner that the scissor beams lie one on top of the other and the sides of the scissor diamonds generated when the lifting scissors are extended out have different lengths.

15 Claims, 4 Drawing Sheets

ELEVATING STAGE

BACKGROUND OF THE INVENTION

1. Technical Field of the Invention

The invention relates to an elevating stage having scissor beam supports.

2. Discussion of the Related

In known elevating stages, scissor beams of the lifting scissors form a straight line and their central and outer moving joints lie vertically one over the other when the lifting scissors are extended upwards. Accordingly, when the lifting scissors are extended from the bottom to the top, the same scissor diamonds are generated, i.e., the higher the lifting scissor is driven out, the smaller the lifting scissor becomes uniformly over its entire height. This arrangement has the drawback that the stability of the elevating stage decreases significantly with advancing height.

Therefore, it is an object of the present invention to improve the elevating stages in such a manner that their stability is independent of the height to which they are extended.

Other objects and advantages of the present invention are apparent from the specification and drawings which follow.

SUMMARY OF THE INVENTION

The foregoing and additional objects are obtained by an elevating stage according to the present invention which includes a stage. A first group of scissor beams of equal length comprises upper, middle, and lower scissor beams pivotally connected end to end and the upper beam is connected to the stage. A second group of scissor beams is provided of equal length to the length of the beams of the first group. This second group also comprises upper, middle and lower scissor beams pivotally connected end to end. The upper beam of the second group is connected to the stage. A means is provided for extending and collapsing the first and second groups of scissor beams. Each scissor beam of the first and second group is upwardly bent at the middle. Also, the scissor beams of the first group are pivotally connected to respective scissor beams of the second group at the beam middle. Such a construction results in the pivotal connections between the beam ends of each of the groups being alternately offset from each other and the pivotal connections between middle beams of the groups being alternately offset from each other. Accordingly, scissor diamonds are formed having sides of unequal length. When extended, these diamonds have a greater taper towards the stage.

DETAILED DESCRIPTION OF THE PREFERRED EMBODIMENTS

Figure 3:
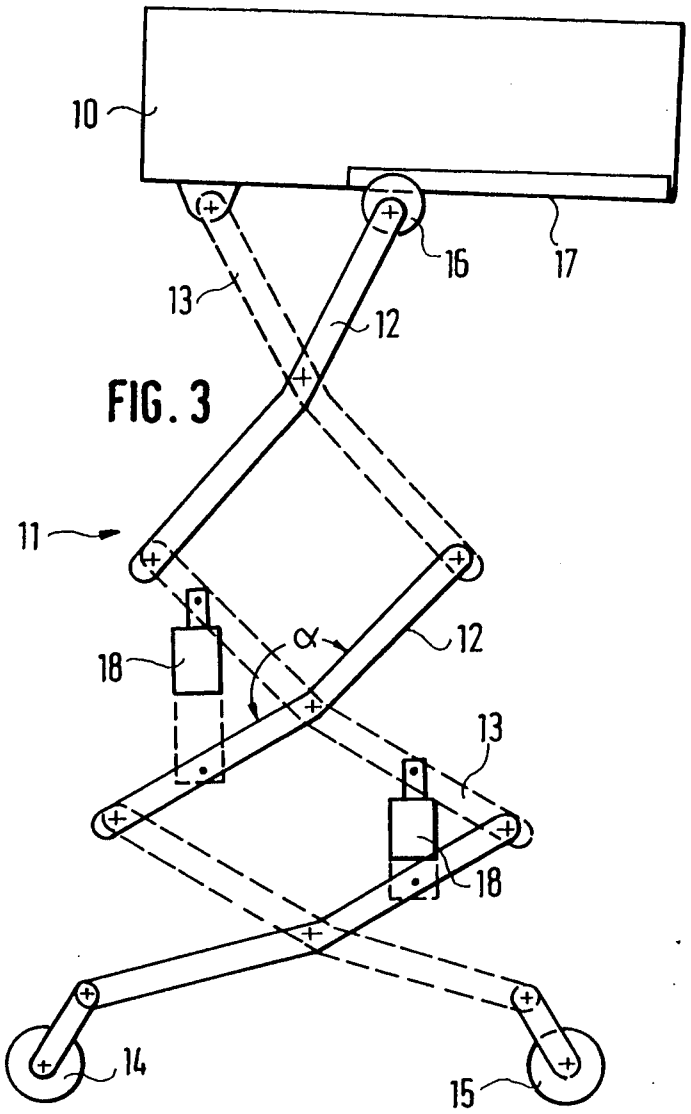
FIG. 3 is a view of FIG. 1, wherein the stage itself is shown, with the lifting scissors completely extended.

The present invention will now be described in greater detail with reference to the accompanying drawings. The elevating stag of FIGS. 1 to 5 comprises essentially the stage 10 and two lifting scissors 11, which carry the stage or platform 10, of which only one is visible in the illustrated side views. Each lifting scissor 11 comprises in turn two groups of scissor beams 12 and 13 which are arranged in two parallel vertical planes in such a manner that in the unextended or collapsed state of the lifting scissor 11 (FIG. 1), the scissor beams of each group lie one on top of the other. All scissor beams 12, 13 have identical lengths and are slightly upwardly bent in the middle, the bend $\alpha$ (FIG. 3) thus being able to form, for example, a 170° angle. Each scissor beam of each group, with the exception of the uppermost and bottommost scissor beam, is hinged to three scissor beams of the respective other group, at the middle and at its two ends. When joined together at the middle, the scissor beams 12, 13 form an X-shaped scissor member.

The bottommost scissor beam of each group is provided with a ground wheel 14 and 15, respectively at its bottom end. The uppermost scissor beam 12 of one group of beams has on its upper end a track wheel 16, which runs in a track 17 located on the bottom side of the stage 10. The upper end of the uppermost scissor beam 13 of the other group is hinged immovable but pivotable at the bottom of the stage. Pneumatic or hydraulic lifting cylinders 18 are arranged in the conventional manner between the scissor beams and serve to extend the lifting scissors. For the sake of clarity, these lifting cylinders have been omitted in FIGS. 1 and 2.

The central bend of the scissor beams 12 and 13 makes it possible for the lifting scissor 11 to taper off towards the top when it is extended, as is clearly apparent from FIG. 3. In this manner the extended elevating stage achieves greater stability, because the track intervals between the ground wheels 14 and 15 grow only slightly smaller with respect to the collapsed state. This also enables the chassis of typical prior lifting scissors to be eliminated. One of the two ground wheels, for example the wheel 14, can be even omitted and replaced by an articulation base. In this case, only the ground wheel 15 and the track wheel 16 carry out a travelling motion when the lifting scissors 11 are extended upwardly. As apparent from FIG. 3, the stage 10 is then in such a stable position that it is possible to safely move directly up to a vertical wall.

The degree to which the lifting scissor 11 tapers off when extended depends on the chosen angle of bend $\alpha$; the smaller the angle $\alpha$, i.e., the greater the bend, the more the extended lifting scissor tapers off towards the top. Preferably, the angle of bend lies between 175° and 165°.

In practice it has been demonstrated that when this lifting scissor with bent scissor beams is extended certain problems arise. Since in the collapsed state of the lifting scissor 11 the central outer moving joints of the scissor beams lie exactly vertically over one another, extension of the lifting scissor generates diamonds whose sides are of the same length. Accordingly, the lifting scissor can hardly be extended from the completely collapsed state if the bend is comparatively severe.

Figure 4:
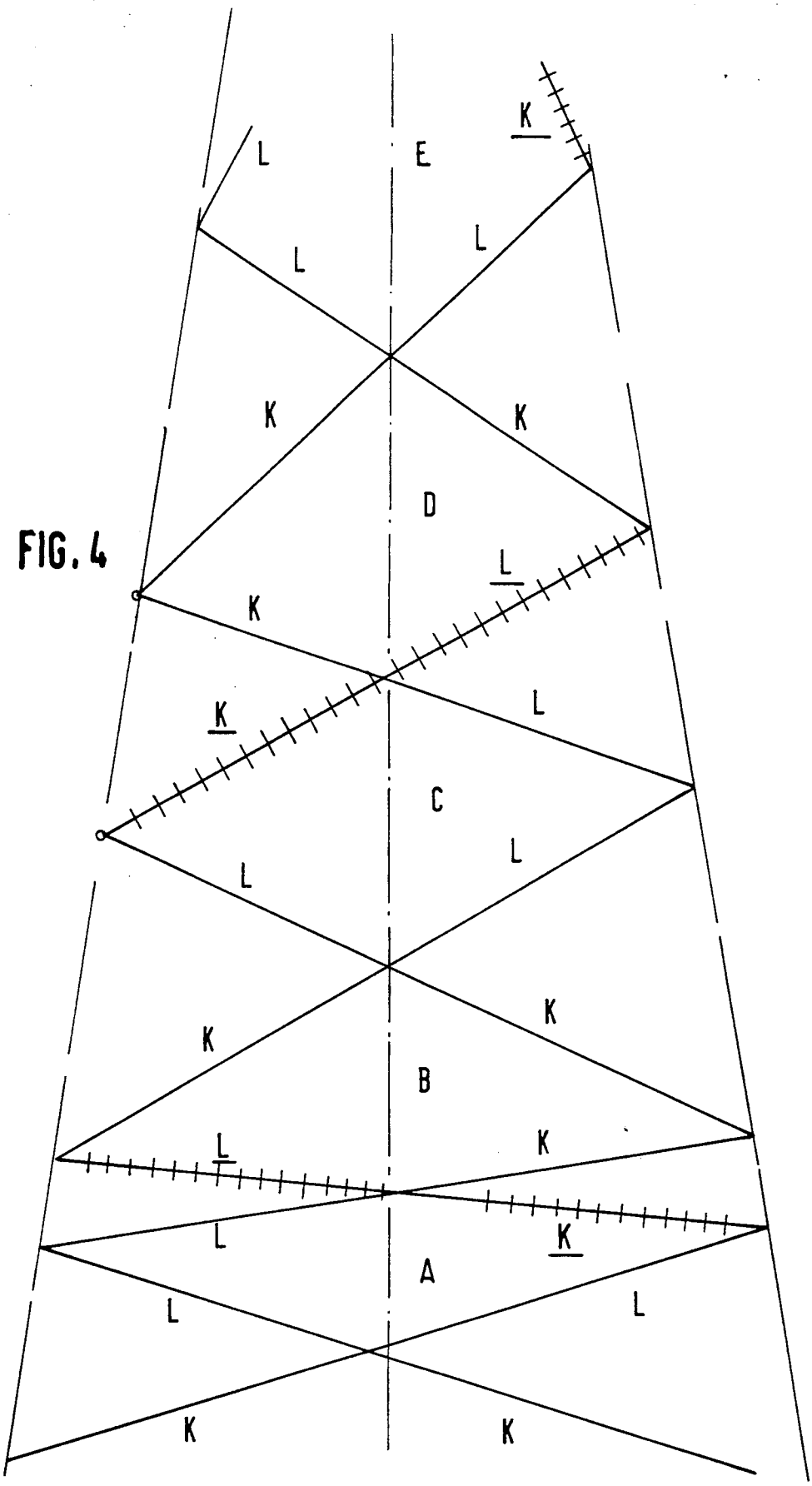
FIG. 4 is a diagram to explain the different lengths of the seconds of the beams of the lifting scissor.

To avoid this problem, the present invention provides that the sides of the scissor diamond resulting when the lifting scissor is extended are of different lengths, as will be explained in detail with reference to FIG. 4. The scissor diamonds resulting when the lifting scissor is driven out are designated as A, B, C, D and E progressing upwards. The lengths of the sides of these diamonds are labelled with two different letters, in particular L and K. Sides L are longer the sides K and, of course, all lengths L of the sides are the same as are lengths K. It is obvious that each of the diamonds has three sides of equal length and an opposing shorter or longer side. Thus, the diamond A has three longer sides L and a shorter side K; and: the diamond B located above it has three shorter sides K and one longer side L. This series continues alternately towards the top. The side that deviates of each diamond is clearly emphasized with serifs in FIG. 4.

Owing to the stability of the lifting scissor, the illustrated order is a good choice. However, other sequences of order are also possible provided that each diamond has three equal sides and the length of one of them has a length that deviates. Thus, for example, in the diamond C the two upper sides could be exchanged, i.e. the right upper side could become K; the upper left, L. In this case, however, the two bottom sides of the diamond D would then have to be exchanged so that the left bottom sides becomes L and the right bottom side becomes K so that each scissor beams 12, 13 once again has a short and a long section. The difference between the sections L and K depends on the degree to which the scissor beams are bent. For example, the short sections K may be shorter by 3% than the longer sections L. A 1% to 5% difference in length constitutes a usable range.

Figure 5:
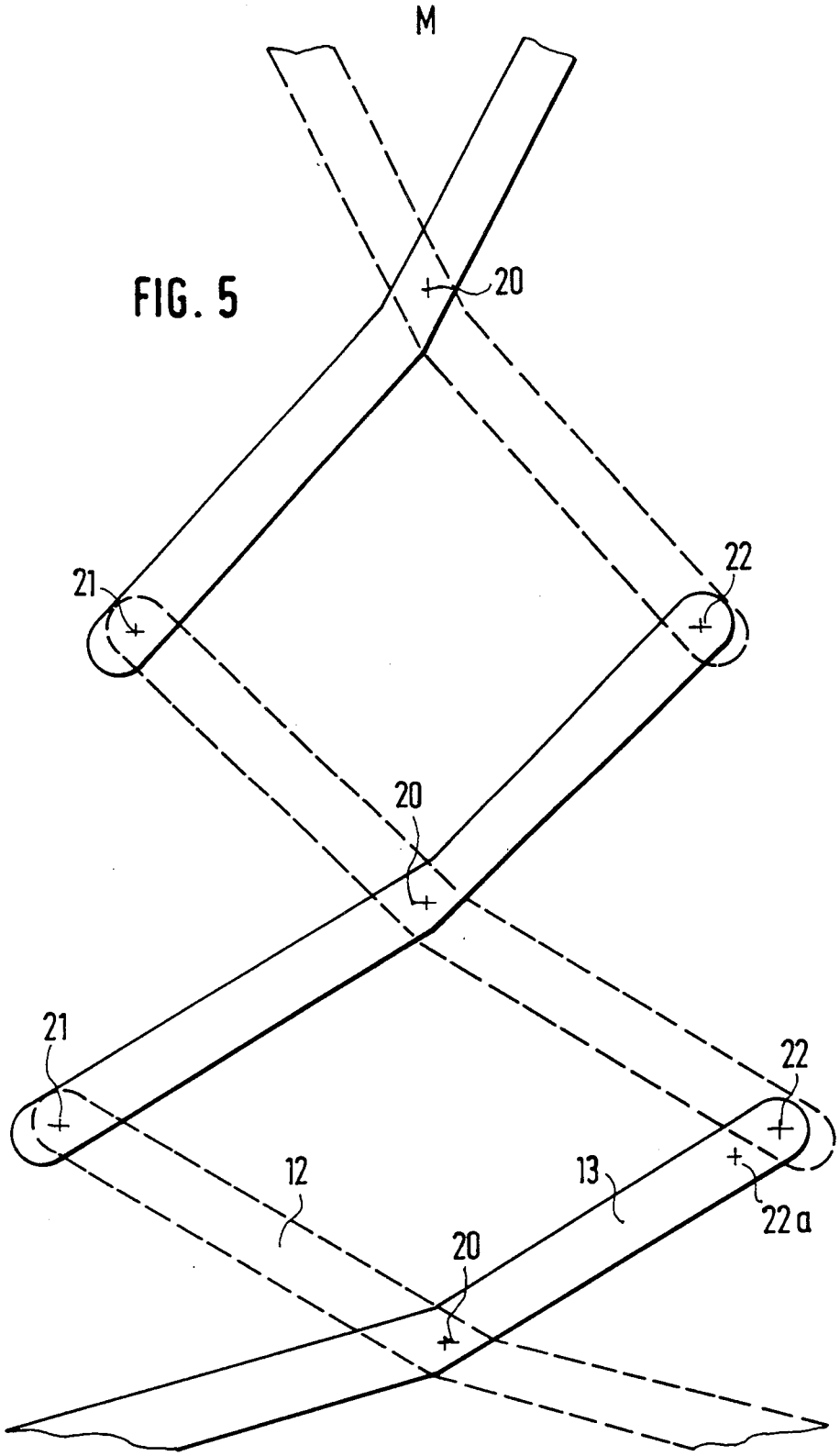
FIG. 5 is a fragmentary view on an enlarged scale from FIG. 3 to explain the configuration of the joints position of the beams of the lifting scissor.

This difference between the lengths of the sections L and K is attained by offsetting the moving joints somewhat, as indicated in FIG. 5 for the center moving joints. It is apparent from FIG. 5 that the center moving joints 20 are offset laterally from the median perpendicular M of the lifting scissor, and in particular from the bottom to the top alternately by the same amount to the right and to the left. The offset is the same for the two scissor beams 12 and 13 which are rotationally connected by means of the joint 20 to form an X-shaped member. In addition, the outer moving joints 21 and 22 are also offset relative to one another with respect to the two scissor beams connected to one another by means of the respective rotatable joint 21, 22. The simplest way to achieve this offset is to provide each scissor beam 12 and 13 at its ends with two bores spaced a short distance in its longitudinal direction, as indicated for example at 22*a*. A hinged pin is inserted through the bore lying further in and belonging to the one scissor beam and the bore lying further out and belonging to the other scissor beam. It becomes apparent from FIG. 4. how the outer joints 21 and 22 must be connected in order to obtain the necessary lengths of the sections K and L for the fixed offset of the center joints 20. The amount by which the center joints 20 and outer joints 21, 22 are offset results automatically from the aforementioned difference in the sections K and L.

By bending the scissor beams and offsetting their moving joints, as explained, a lifting scissor results that can be completely extended and collapsed and which has the desired tapering off towards the top when extended. The number and length of the scissor beams can of course be adapted to the specific requirements of the operating environment.

Figure 6:
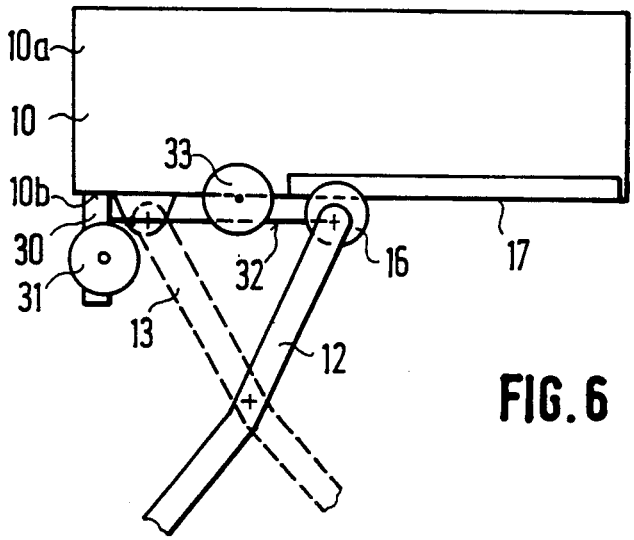
FIG. 6 is an enlarged, fragmentary view of a variation of the stage with the lifting scissors completely extended.
Figure 7:
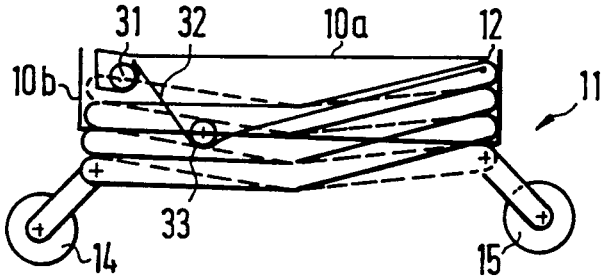
FIG. 7 is a schematic of the elevating stage of FIG. 6 with collapsed lifting scissors.

FIGS. 6 and 7 show another embodiment of the invention in which another power drive is used to actuate the lifting scissors. The power drive is used to actuate the lifting scissors The power drive comprises a motor 30, preferably an electric motor with forward and reverse, which is fastened to the bottom of the stage 10. An accumulator can serve, for example, as the power supply and can be mounted at the bottom end of the lifting scissor and connected by a cable to the motor 30. The motor 30 drives a cable drum 31 via a worm-gear drive. A cable 32 is wound on the drum 31 and has a free end fastened to the upper end of the uppermost scissor beam 12 which carries the track wheel 16.

Figure 1:
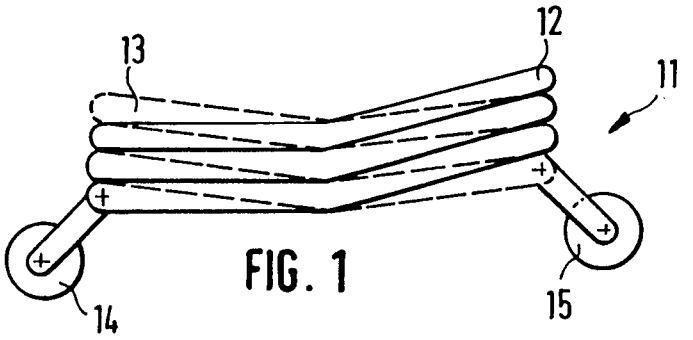
FIG. 1 is a side view of the elevating stage (the stage itself has been omitted) in the collapsed state of the lifting scissors.
Figure 2:
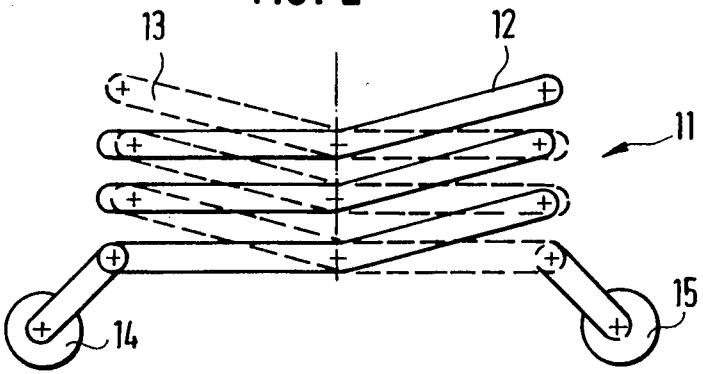
FIG. 2 is a view of FIG. 1 with the lifting scissors extended slightly.

The function of this power drive is clear from the drawing. As the motor 30 turns the cable drum 31 counterclockwise in FIG. 6 the rope 32 is wound up and the scissor beam 12 is drawn in the direction of the drum 31, i.e., to the left in the drawing, with the result that the lifting scissors move the stage 10 towards the top until the highest position of the stage has been reached. Conversely, as the motor 30 rotates in the opposite direction i.e., clockwise in FIG. 6, the cable 32 unwinds. The weight of the stages 10 pushing the scissor beam 12 is thus to the right on beam 12. If the cable 32 is kept under tension until the wheel 16 has reached the right terminal end of track 17, the lifting scissor is completely collapsed in a controlled manner as shown in FIG. 1 of the first embodiment. As discussed previously, the stage 10 is supported by two lifting scissors which in the drawing are in tandem. To achieve a more uniform drive, the two rollers 16 are connected by a shaft or an respectively driven by two motors 30 that are in synchronization with one another and having cable drums 31 attached to the stage 10.

In addition to this described cable line drive, the embodiment of the lifting stage of FIGS. 6 and 7 has still another improvement. Namely, the subdivision of the stage 10 into a peripheral stage railing 10*a* and a stage platform 10*b*. The platform 10*b* is provided on its bottom with the track 17 in which the roller 16 of the uppermost scissor beam 12 engages, and, in addition, is hinged to the uppermost scissor beam 13 of the other group of beams. The motor 30 is also fastened to the plate 10*b*. This means that the platform 10*b* is raised and lowered with the lifting scissors analogous to the stage 10 of the embodiment of FIGS. 1 to 5. In contrast, the stage railing 10*a* is separated from the platform 10*b* and exhibits a slightly larger outline so that the peripheral railing 10*a* can be moved, thus, vertically to the plane of the platform. This shifting is caused by a roller 33 that is attached to the bottom edge of the railing 10*a* and has a circumferential guide groove which engaging the cable 32. In the position shown in FIG. 6, the railing 10*a* is completely extended toward the top, thus representing the mandatory protection for a person standing on the platform 10*b*. This extended position is also retained when the platform 10*b* is lowered, because even here, as stated above, the cable 32 remains under tension as a consequence of the weight of the platform 10*b*. After the platform 10*b* is completely lowered, i.e., when the lifting scissors are completely collapsed the motor 30 revolves again clockwise. Thus, the cable 32 loses its tension and the roller 33 pushes the cable 32 downward, with the result that the railing 10*a* is lowered, preferably until the upper edge of the railing 10*a* lies in a plane with the plane of the platform 10*b*. This is shown in a schematic in FIG. 7. Thus, the height of the collapsed lifting stage, is significantly reduced, thereby facilitating transportation and storage. In addition, the lifting scissors are protected during transport by the railing 10*a* that is slipped over the scissors. If the motor 30 revolves again counterclockwise in order to extended the lifting stage, then the cable 32 is tensioned to result in the railing 10*a* being driven up or extended. The elevation of the lifting scissor and thus, the elevation of stage platform 10*b* does not begin until the railing 10*a* is completely driven up. Of course, platform 10*b* and railing 10*a* can be connected to one another in such a manner by a parallelogram linkage that a precise vertical elevation of by the railing 10*b* is ensured. A locking mechanism for the railing 10*b* in its driven-up position that can be released by the operating person can also be provided.

Further modification and improvements will be apparent to one skilled in the art without departing from the spirit and scope of the present invention as defined in the following claims.

I claim:

1. An elevating stage comprising:

a stage;

a first group of scissor beams of equal length comprising upper, middle, and lower scissor beams pivotally connected end to end, the upper beam connected to said stage;

a second group of scissor beams of equal length to the length of the beams of said first group, said second group comprising upper, middle and lower scissor beams pivotally connected end to end, the upper beam of said second group connected to the stage; and means for extending and collapsing said first and second groups of scissor beams, wherein each scissor beam of said first and second group is upwardly bent at the middle, and the scissor beams of said first group are pivotally connected to respective scissor beams of said second group at the beam middle, and wherein the pivotal connections between the beam ends of each of said groups are alternately offset from each other and the pivotal connections between middle beams of said groups are alternately offset from each other, whereby scissor diamonds are formed having sides of unequal length by portions of the first and second groups of scissor beams.

2. Elevating stage according to claim 1, wherein each scissor beam of said first and second groups are bent such that a bend angle of between 165° and 175° exists at the middle of the beam.

3. Elevating stage according to claim 1, wherein each scissor diamond has three sides of equal length and one side thereof has a deviating length, and the length of the deviating side is alternately longer and shorter than the length of the other sides of the diamond.

4. Elevating stage according to claim 3, wherein the deviation in length of the diamond sides is between approximately 2% and 5% of the entire length of the scissor beam.

5. Elevating stage according to claim 1, wherein each scissor beam has on its ends two joint bores.

6. Elevating stage according to claim 1 wherein an upper end of the upper scissor beam of said first group is hinged to the bottom side of the stage and an upper end of the upper scissor beam of said second group provided with a wheel which can be moved on a track attached to the bottom side of the stage.

7. Elevating stage according to claim 1, wherein at least one of the lower scissor beams of said groups is provided with a wheel.

8. Elevating stage according to claim 1, where said extending and collapsing mean comprises lifting cylinders connected to the scissor beams.

9. Elevating stage according to claim 6, wherein said extending and collapsing means comprises a drive motor which has a cable drum and is attached to said stage, a free end of the cable of the cable drum being fastened to the upper end of the upper scissor beam of said second group provided with the wheel.

10. Elevating stage according to claim 1, wherein the stage comprises a platform and a railing which can be automatically raised and lowered relative to the platform.

11. Elevating stage according to claim 9, wherein the stage comprises a platform and a railing which can be automatically raised and lowered relative to the platform.

12. Elevating stage according to claim 10, wherein a roller rests on the cable of the cable drum and is arranged on the bottom edge of the stage railing.

13. Elevating stage according to claim 12, wherein the stage railing is guided vertically to the platform.

14. A mechanism for elevating a stage comprising:

a first X-shaped scissor member comprising two scissor beams of equal length rotatably connected to each other at the middle, each scissor beam having upper and lower ends and being bent upwardly at the middle;

a second X-shaped scissor member comprising two scissor beams of equal length rotatably connected to each other at the middle, each scissor beam having upper and lower ends and being bent upwardly at the middle;

a third X-shaped scissor member comprising two scissor beams of equal length rotatably connected to each other at the middle, each scissor beam having upper and lower ends and being ben upwardly at the middle;

means for pivotally connecting the upper ends of the scissor beams of the first X-shaped member to the scissor beams of the second X-shaped member near the lower end of the second scissor beams;

means for pivotally connecting the upper ends of the scissor beams of the second X-shaped member to the scissors beams of the third X-shaped member near the lower end of the third scissor beams, means for pivotally connecting the upper end of one of the scissor beams of the third X-shaped member to the stage;

means for translating the upper end of the other scissor beam of the third X-shaped member along the stage; and means for extending and collapsing the X-shaped members, whereby the pivotally connected X-shaped members form diamonds having three sides of equal length and a fourth side which is alternately longer and shorter than the three equal sides.

15. An elevating stage comprising:

a stage;

a first group of scissor beams of equal length comprising upper, middle, and lower scissor beams pivotally connected end to end, the upper beam connected to said stage;

a second group of scissor beams of equal length to the length of the beams of said first group, said second group comprising upper, middle and lower scissor beams pivotally connected end to end;

means for extending and collapsing said first and second groups of scissor beams;

means for pivotally connecting an upper end of the upper beam of said first group to the stage; and means for translating an upper end of the upper beam of said second group along the stage;

wherein each scissor beam of said first and second group is upwardly bent at the middle, and the scissor beams of said first group are pivotally connected to respective scissor beams of said second group at the beam middle, and wherein the pivotal connections between the beam ends of each of said groups are alternately offset from each other and the pivotal connections between middle beams of said groups are alternately offset from each other, whereby scissor diamonds are formed having sides of unequal length by portions of the first and second groups of scissor beams.

* * * * *